US008037648B2

(12) United States Patent
Vanderhoef

(10) Patent No.: US 8,037,648 B2
(45) Date of Patent: Oct. 18, 2011

(54) INTERLOCKING TILE

(75) Inventor: John P Vanderhoef, Cummaquit, MA (US)

(73) Assignee: SelecTech, Inc., Avon, MA (US)

( * ) Notice: Subject to any disclaimer, the term of this patent is extended or adjusted under 35 U.S.C. 154(b) by 0 days.

(21) Appl. No.: 12/720,379

(22) Filed: Mar. 9, 2010

(65) Prior Publication Data

US 2011/0061330 A1 Mar. 17, 2011

Related U.S. Application Data

(63) Continuation of application No. 12/074,103, filed on Feb. 29, 2008, now Pat. No. 7,676,995, which is a continuation of application No. 10/769,364, filed on Jan. 30, 2004, now Pat. No. 7,340,865.

(51) Int. Cl.
*E04F 15/00* (2006.01)

(52) U.S. Cl. ..... 52/177; 52/384; 52/591.4

(58) Field of Classification Search ..... 52/177, 52/180, 384, 390, 392, 403.1, 519, 574, 578, 52/579, 586.1, 589.1, 591.1, 591.2, 591.4, 52/591.35, 592, 597.1; 428/60, 61, 81, 88, 428/192; 15/238; 446/85, 108, 110, 116
See application file for complete search history.

(56) References Cited

U.S. PATENT DOCUMENTS

| | | | | |
|---|---|---|---|---|
| 3,077,426 | A | 2/1963 | Johnston | |
| 3,657,852 | A | 4/1972 | Worthington et al. | |
| 3,895,456 | A | 7/1975 | Fabre | |
| 3,909,996 | A | 10/1975 | Ettlinger et al. | |
| 4,287,693 | A | 9/1981 | Collette | |
| 4,685,892 | A | 8/1987 | Gould et al. | |
| 5,630,304 | A | 5/1997 | Austin | |
| 5,907,934 | A | 6/1999 | Austin | |
| 5,950,378 | A | 9/1999 | Council et al. | |
| 5,992,106 | A | 11/1999 | Carling et al. | |
| 6,098,354 | A | 8/2000 | Skandis | |
| 6,306,318 | B1 | 10/2001 | Ricciardelli | |
| 6,451,400 | B1 | 9/2002 | Brock et al. | |
| 6,508,690 | B2 * | 1/2003 | Axelrad | 446/108 |
| 6,526,705 | B1 | 3/2003 | MacDonald | |
| 6,751,912 | B2 | 6/2004 | Stegner et al. | |
| 6,820,386 | B2 | 11/2004 | Kappeli et al. | |
| 7,340,865 | B2 | 3/2008 | Vanderhoef | |
| 2002/0189183 | A1 | 12/2002 | Ricciardelli | |
| 2003/0093964 | A1 | 5/2003 | Bushey et al. | |
| 2005/0066606 | A1 | 3/2005 | Dolinski | |

* cited by examiner

*Primary Examiner* — William Gilbert
(74) *Attorney, Agent, or Firm* — Jerry M. Presson; Thomas F. Presson

(57) ABSTRACT

A polymeric interlocking tile for an adhesive-free assemblage with adjacent tiles having substantially similar, but inverted, edge interlocks thereon. The interlocks on each edge of a tile include a row of first and second sets of male-female types of alternating interlocks. The first interlock set includes a male lug projection having sidewalls forming one sidewall of a channel of U-shaped cross-section. The channel forms a female interlock cavity for the first set. The second interlock set is contiguous to the first set and includes a male projecting rib having two parallel sidewalls, one sidewall faces the edge and forms an opposite sidewall of the channel and an opposite, inwardly facing sidewall forms an enclosure for a second female cavity of the next set. At the opposite ends of each interlock row, the U-shaped channel sidewalls are wider to facilitate an initial interlock meshing between contiguous tiles of the assemblage.

8 Claims, 5 Drawing Sheets

INTERLOCKING TILE

This is a continuation application of U.S. application Ser. No. 12/074,103, filed on Feb. 29, 2008, now U.S. Pat. No. 7,676,995, which is a continuation application of U.S. Ser. No. 10/769,364, filed Jan. 30, 2004, now U.S. Pat. No. 7,340,865 the entirety of which being incorporated herein by reference.

BACKGROUND OF THE INVENTION

1. Field of the Invention

The present invention relates generally to adhesive-free, interlocking tiles and, more specifically, to an improved interlock structure for interlocking an assemblage of contiguous floor tiles with uniformly straight edges.

2. Background Discussion

Adhesive-free, interlocking floor tiles are typically molded of substantially resilient, plastic material and utilize interlock elements formed in the tile edges for effecting connections with adjacent, similar tiles. Typically, the interlock elements are pairs of substantially identical alternating projections and slots of substantially dovetail shapes. The projections and slots are supported by the tile edges to effect mating interlocks with inverted, substantially identical slots and projections, respectively, on other tiles to effect a mating interference fit between contiguous tiles of an assemblage, such as, an assemblage of floor tiles.

The projections serve as the male interlock elements and are typically dovetailed shaped; that is, shaped as truncated triangles with rounded corners in plan view and disposed in alignment along each tile. The male projections are alternately spaced by contiguous slots of substantially the same size and shape as the male projections, but inverted to form the female interlocking elements. Typically therefore, the slots are of identical dovetail shape and those on at least two exposed elements support edges of the tile are joined at right angles. The slots extend completely through these edges to provide female counterparts to the male elements. Interlocking of contiguous floor tiles on-site is effected by vertically aligning the male and female interlock elements of one tile with respective inverted female and male interlock elements of contiguous tiles and then driving the interlocks into resilient interference engagements by means of, for example, a mallet. The integrated installation, when thusly installed over flooring substrates, such as concrete or plywood, requires no adhesives or fasteners, and is therefore often referred to as "adhesive-free." The male-female element pairs form one set each of the interlock structures disposed along the tile edges so that there is a series of contiguous pairs of projections and slots joined by a common dovetail-shaped sidewall.

For certain floor tile applications it is preferred that the tiles have four edges with one pair thereof joining at right angles to provide one corner of the tile and two uniformly solid, straight edges which define two of the four or more square or rectangular side edges of a multi-sided tile, depending on the particular overall tile shape. The pair of solid edge portions serves as straight, overlying support edges for downwardly facing interlock elements when the tile is installed horizontally. The edges have top surfaces as flush extensions of the top surface of the tile body and provide flat, top surfaces with a pair of solid, straight top edges, thereby simulating a conventional ceramic tile assemblage with linear grout lines or wood flooring with grooves and flush, coplanar top surfaces. An oppositely disposed, and second, pair of edges intersect at right angles to form a second opposite corner of the tile. The second pair of edges are likewise provided with a sequence of male-female interlocks defined by sidewalls which extend completely through the tile edges perpendicular to the plane of the tile to mate with the downwardly-projecting respective female and male interlocks of contiguous, substantially identical tiles. Examples of tiles having such interlock arrangements are disclosed by U.S. Pat. No. 4,287,693 issued on Sep. 8, 1981 to R. E. Collette; U.S. Pat. No. 6,526,705, issued on Mar. 4, 2003 to K. M. MacDonald; and, U.S. patent application Ser. No. 09/884,638, filed Jun. 19, 2001 by T. E. Ricciardelli and assigned to the same assignee as the present invention; all of the references referred to above being incorporated by reference herein and made part hereof.

The extent to which each essentially identical pair of interlock elements can effectively function to prevent tile separations during usage is a function of tile composition and the design of the interlocks with various considerations as to tile resilience and the extent of surface area available for intermating surface-to-surface engagement between interlocks, and other relevant factors known to those in the art. Thus, with certain of the prior art interlock structures, the two sides of the tile opposite those with solid edge portions utilize the full tile edge thickness for at least the female cavity sidewalls by molding dovetail slots as through-slots into the tile edges. The resulting tile has a pair of top linear edge portions and a pair of opposite or bottom edge portions with alternating nonlinear or undulating edges. Advantageously, the latter may be hidden from view after tile assemblage by the overlying straight and solid top edge portions of contiguous tiles, and therefore, the top surfaces of the final tile assemblages have the desired uniformly straight edge lines and flush, top edge surfaces.

For a given thickness of tile, the pair of flush solid support edges forming the periphery of the top surface account for a portion of the overall tile thickness and consequently reduce the surface areas available for mating engagements between the identical pairs of interlock elements. This is because the female cavities have a reduced depth as a result of being dead-ended on-their underlying solid support edges. The male projections are also limited in height because they cannot extend beyond the planes of the top or bottom surfaces of the tile. As a result, the surface areas available to effect interelement mating engagements is reduced, which is disadvantageous from a connective integrity standpoint. Conversely, this advantageously results in a reduction in the impact forces required to drive the downwardly-facing interlocks on the top tile edges into mating engagements with upwardly-facing interlocks of adjoining tiles, and consequently reduces the effort required for on-site tile installation.

It would be advantageous to provide a generally planar tile with multiple sides and a top surface having an underlying interlock structure that is adapted to facilitate on-site assemblage and removal of individual tiles with matable interlock structures on contiguous tiles, and yet is resistant to separation of the assemblage during usage.

An embodiment of this invention is to provide an interlocking tile with planar top and bottom surfaces and at least two linear edges extending at right angles to one another having different sets of interlock elements underlying the top edge surfaces which are specifically designed to facilitate on-site installation and removal and replacement, if required, of individual tiles without significantly degrading the resistance to tile edge separations during usage.

Yet another embodiment is to provide an adhesive-free tile assemblage with an interlock structure comprised of multiple pairs of differently constructed interlocks providing acceptable connective interlock integrity while facilitating the ease by which on-site installation assemblage and replacement of individual tiles can be effected with mating tiles having substantially identical, inverted interlock structures thereon.

Yet another embodiment is to provide an edge interlock system for a resilient tile that facilitates the initial connections and aligned orientations between the interlocks of that tile and the interlocks of similarly constructed contiguous tiles.

SUMMARY OF THE INVENTION

These embodiments are achieved by the instant invention which provides a multi-sided, interlocking tile with a corresponding multi-sided, substantially planar central portion with first, second, third and fourth elongated interlock element support edges disposed in end-wise relationship and cantilevered from different sides of the central portion. The inner edge portions of the support edges are formed integral with the central portion and extend laterally outwardly therefrom with the free, outer edge portions thereof defining the tile periphery. The first and second interlock support edges have longitudinal axes intersecting at substantially right angles to provide a first pair of adjoining interlock support edges on two sides of the central portion having interlock support surfaces that face toward the plane of the top tile surface or "upwardly." Similarly, the third and fourth interlock support edges intersect at right angles to provide a second pair of adjoining interlock support edges on another two sides of the central tile portion having interlock support surfaces that face toward the plane of the bottom tile surface or "downwardly." With this inverted arrangement of interlock support edges, a flat, uniformly solid, top tile, surface is available for the application of a square cornered laminate decorative and/or wear resistant layer applied during or after the tile molding process.

There are series of two sets each of different, male-female interlock elements on each support edge and the two sets are disposed in longitudinal alignment and project from one surface of each support edge. The two sets of interlock elements are joined by a common sidewall that traverses the surface of the underlying support edge from substantially one end to the other. The sidewalls on the first pair of support edges project upwardly and the sidewalls on the second pair of support edges project downwardly. Both sets of the interlock elements are comprised of male walled structures; one of the structures being a lug-like element and the other being a section of a rib-like element with substantially parallel inner and outer spaced-apart sidewalls. The lug and laterally opposite outer sidewall of a rib section are laterally spaced to form an essentially U-shaped channel therebetween that bottoms on its respective support edge surface. The channel forms a female interlock portion for the first of the two interlock sets, whereas the adjacent lug forms the male interlock portion of that first interlock set.

The inner sidewall of the rib section forms an open-ended cavity also bottoming on it's enclosed support edge surface and this cavity forms the female interlock element for the second interlock set. Each of the rib sections projecting from its respective support surface is shaped to form the male interlock element for the second interlock set. The male and female elements of the two sets are shaped and sized as identical inverted counterparts of one another, so that adjacent tiles having substantially identical inverted first and second interlock sets can mesh and be matingly secured together without use of adhesives. The open-ended design of the interlocks and the tile resilience enables an installer to more readily replace individual tiles of the assembly by simply picking up one corner of the tile to effect initial separation between the interlocks. Additionally, the interlock sets on the corner ends of support edges are designed to mesh with less applied pressure and greater tolerances to initial misalignment than that required for other prior art sets of interlocks, thereby facilitating the initial interconnecting and alignments with similar interlocks of contiguous tiles and any subsequent removal of individual tiles.

The invention will now be described in more detail with reference to the accompanying drawings.

DETAILED DESCRIPTION

Figure 1:
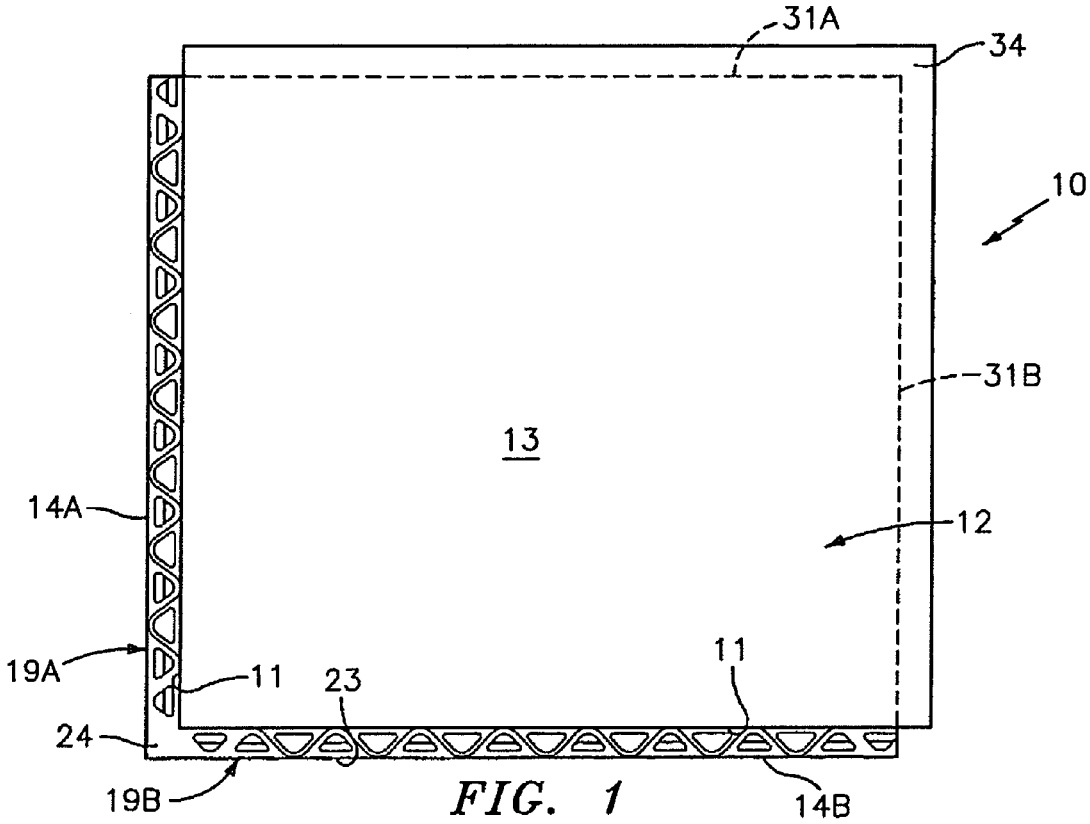
FIG. 1 is a top plan view of a tile with edge interlocks constructed in accordance with the instant invention.

With reference to the drawings, FIG. 1 shows a top plan view of a tile 10, constructed in accordance with this invention. The tile 10 is illustrated as having a substantially squared-shaped upper or top planar surface 13 and a lower or bottom planar surface 14 of substantially the same dimensions, the planes of the two surfaces 13 and 14 being essentially parallel and defining therebetween the "vertical" or perpendicular thickness of the tile 10. The surfaces 13 and 14 are shown to be essentially of square shape, but may have other geometric shapes as well, for example rectangular, as disclosed in co-pending U.S. patent application Ser. No. 09/884,638, referred to hereinabove. Preferably, the top edges of the tile are uniformly solid and linear so that the tiles provide straight, solid edges with right-angled corners. The surfaces of the bottom 14 may be embossed or otherwise patterned (not shown) for slip-resistance enhancement.

Figure 5:
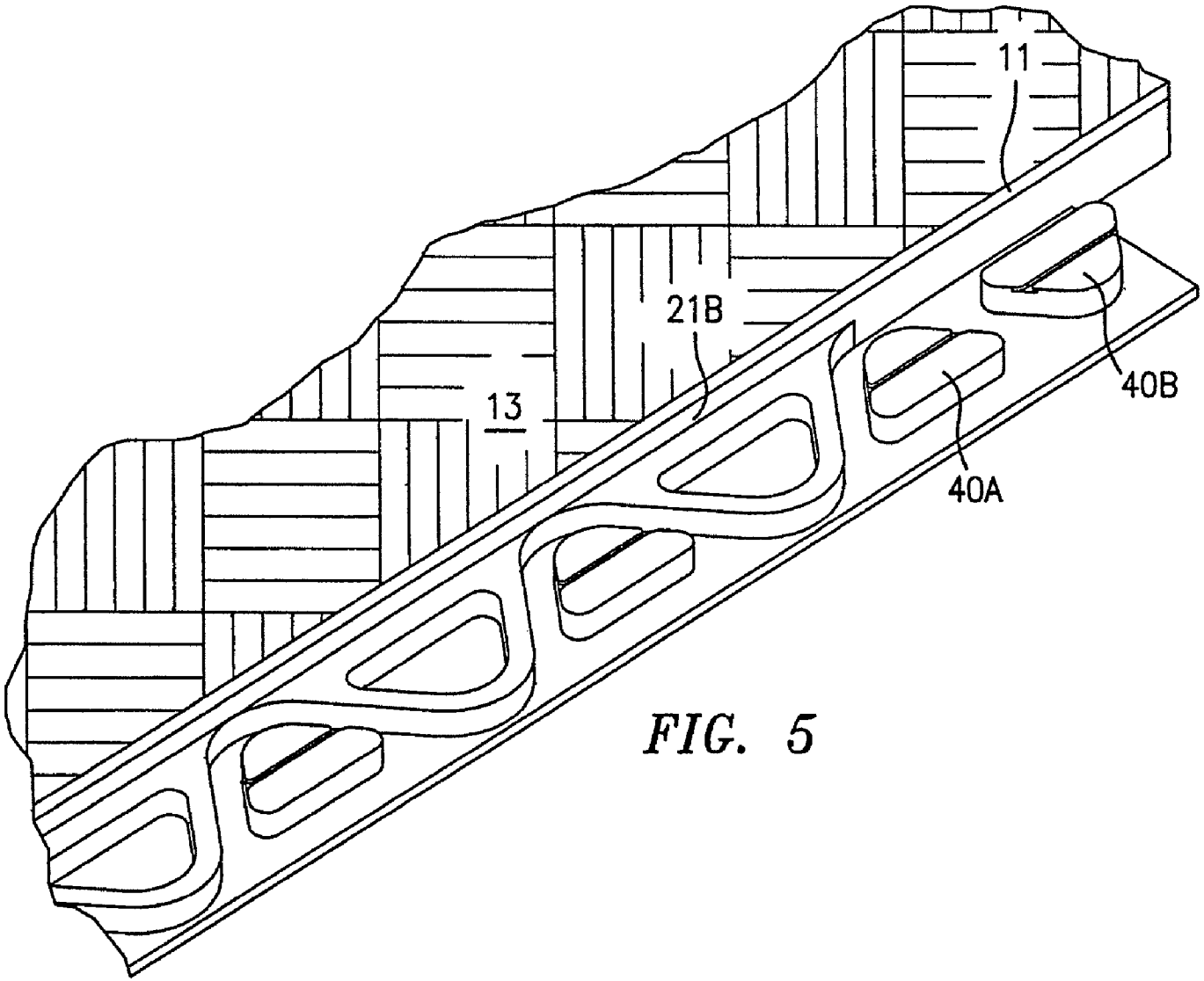

The tile 10 is preferably composed of substantially resilient materials, such as; polyvinyl chloride (PVC), polypropylene, polyethylene, and natural or synthetic rubber or mixtures thereof that provide the molded products with a somewhat cushiony surface desirable for floor coverings and the substantially resilient interlock structures desirable for tight-fitting, essentially resilient interlocks. Advantageously, the tile 10 may be composed of recycled waste carpet scraps, as disclosed in U.S. Pat. No. 6,306,318 issued on Oct. 23, 2001, and assigned to the same assignee as the instant invention. As disclosed therein, a matrix of granulated waste polymeric carpet backing and carpet fibers and a suitable plasticizer, after being subjected to high heat and compressive forces in an injection molding machine, will produce a molded tile of PVC with embedded carpet fibers. As illustrated in FIG. 5, to enhance the aesthetic appearance of a floor tile assemblage, a variety of decorative polymeric-based sheets, such as decorative vinyl sheets, may be laminated to the top surface of the tile 10 to provide a decorative top layer 11 to the tile 10. The layer 11 may be covered by transparent wear-resistant layer, not shown, if required.

Figure 2:
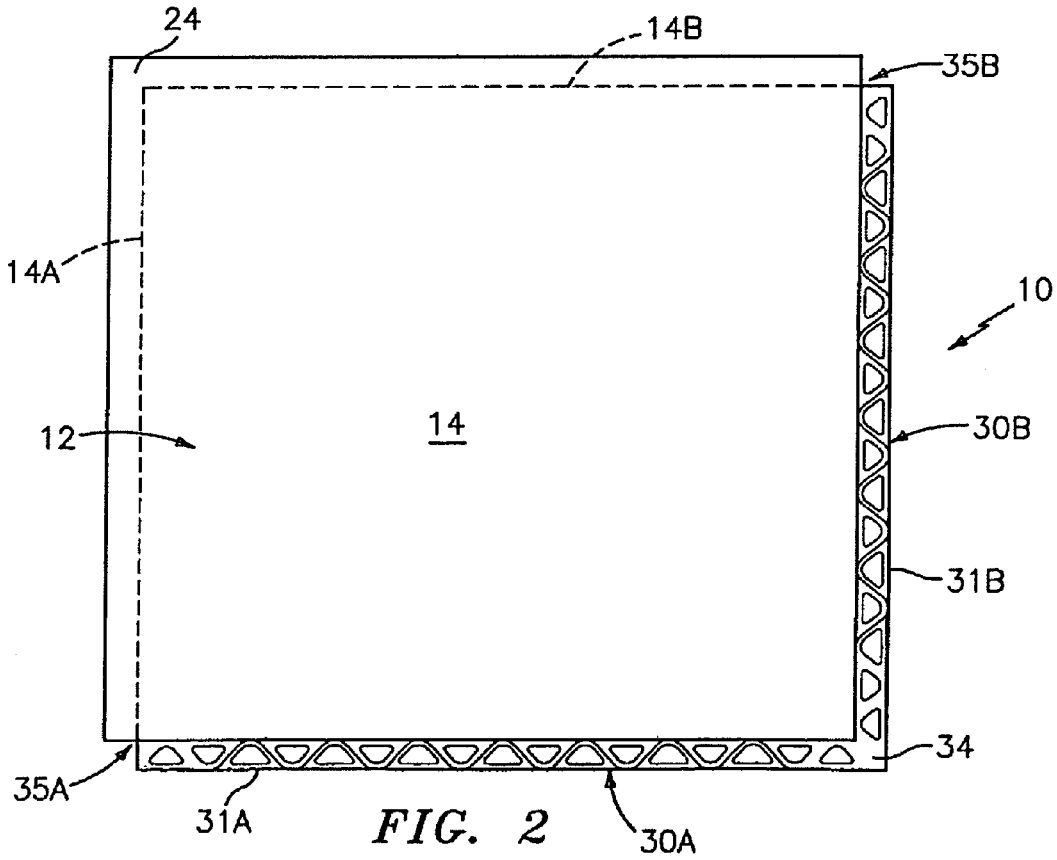
FIG. 2 is a bottom plan view of the tile shown in FIG. 1.
Figure 3:
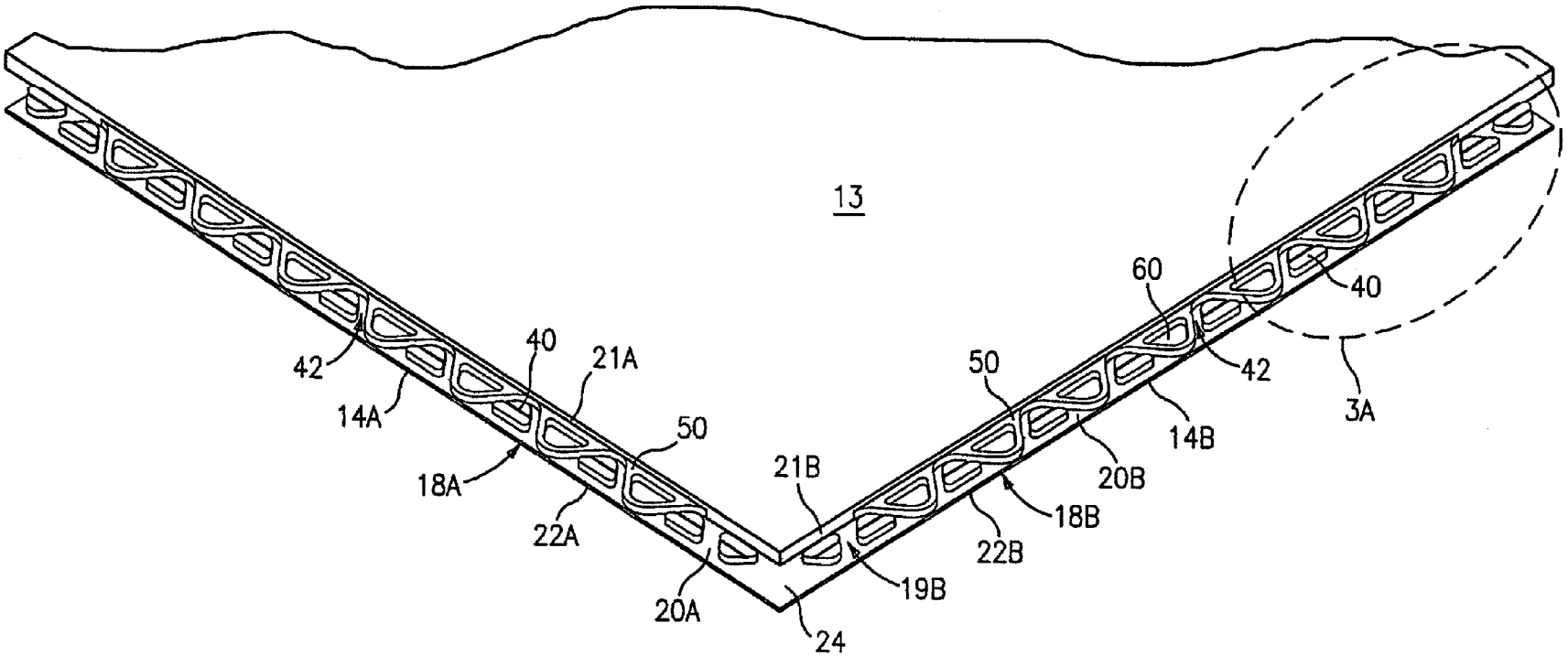
FIG. 3 is an isometric perspective of the left-hand corner of the tile shown in FIG. 1.

The tile 10 is shown in plan view in FIGS. 1 and 2 with a generally square-shaped central portion 12 of basic tile body thickness with two pairs of interlock edges; a first one of said pairs designated by numerals 14A and 14B in FIGS. 1 and 3 is comprised of two substantially identical elongated edge strips 19A and 19B, respectively, having substantially rectangular cross-sectional shapes. The strips 19A, 19B have respective flat top surfaces 20A, 20B, FIGS. 3 and 3A, that support interlock elements and face upwardly in the direction of a plane containing the top tile surface 13. A pair of opposite bottom surfaces 14A, 14B, respectively, FIGS. 2 and 4, extend as flush border edge continuations of the central region 12 of the bottom tile surface 14. The longitudinal axes of the strips 19A, 19B, FIG. 3, intersect at right angles to define one of the right-angled corners 24 of the tile 10, and the strip surfaces 20A, 20B typically face upwardly when the tile is mounted with its bottom surface 14 against a floor substrate. The outermost first pair of tile 10 edges, FIG. 3, is uniformly solid and substantially straight edges 22A and 22B, respectively, simulating linear grout or groove lines which typically result when conventional ceramic tiles or wood flooring planks are assembled in abutting relationships.

Figures 3A, 4A:
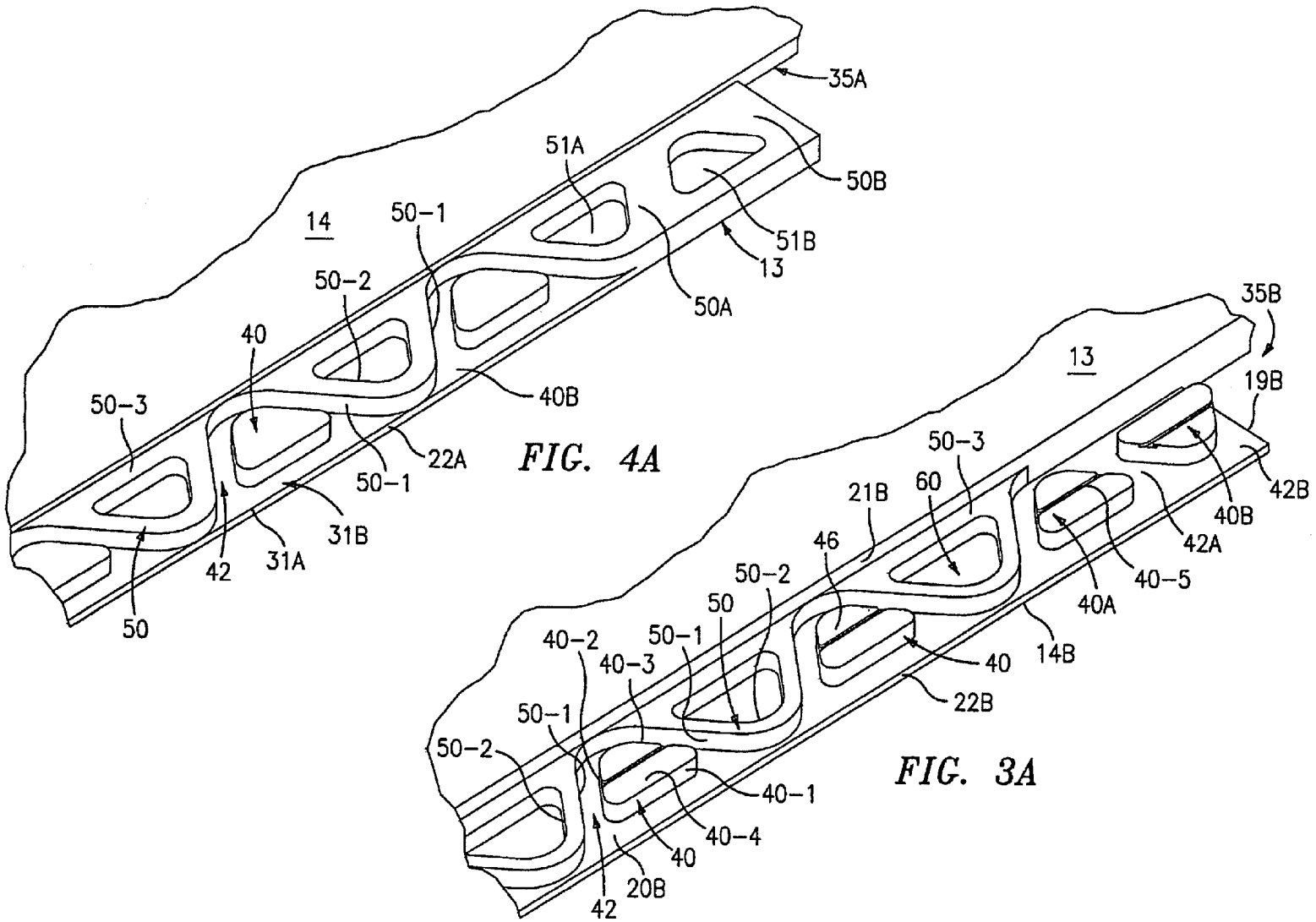
FIG. 3A is an enlargement of the right-hand corner of FIG. 3, delineated by dash lines in FIG. 3.

As best seen in FIGS. 3 and 3A, the strips 19A and 19B have a vertical thickness of approximately one-quarter the corresponding total thickness dimension of the tile 10, including any additional decorative or wear layers 11 applied thereto. Typically, the portion 12 is about 15-20 inches and more specifically, about 17 inches on each side and the tile thickness with a decorative layer 11 is about 0.125-0.5 inch and more specifically, about 0.25 inch; although such dimension will vary depending upon the particular installation for weights, flexibility, and wear resistant requirements, as apparent. Flexibly cantilevered from their corresponding outer edges 21A, 21B of the central tile portion 12 the strips 19A, 19B intersect at right angles with those edges to form downwardly stepped corner edges at 21A and 21B, respectively, that extend parallel to support edges 20A and 20B, respectively, and intersect at right angles to one another at the left-hand corner of tile 10, FIG. 3. Typically, the strips 19A and 19B have exemplary width dimensions of about 0.5 inch to 1.0 inch and more specifically, about 0.75 inch. The dimensions of the strips are a function of the overall dimensions of the tile 10 and the size of the interlock elements molded into the strips. With the exemplary dimensions disclosed above, the top surface 13 has approximately a 15-20 inch border and more specifically about a 17.75 inch border edge. The depth or thickness of the edges 21A, 21B of the strips 19A, 19B respectively contiguous to and abutting the interlocks is determined by the vertical spacing required between the plane of top surface 13 and the interlock engaging surfaces of the interlock structures to provide flush edges with those of similar adjoining tiles. As will be apparent from FIG. 5, for a predetermined height of interlock projections and depth of adjacent cavities described in greater detail hereinafter, this vertical spacing will be incrementally increased in the event additional single or composite material compatible and flexible layers 11 are applied by heat bonding or adhesives to the top tile surface by the amount that such layer or layers incrementally increase the thickness of the tile. To maintain a predetermined maximum tile thickness for desired flexibility, the thickness of the strips 19A, 19B may be reduced by an increment substantially equal to the height increase attributable to the addition of the layers 11. Typically the layers 11 will have a thickness ranging from 0.002 inch to 0.004 inch in total thickness. Typically, the top layer 11 comprises a layer of 0.004 to 0.020 inch of flexible PVC to which may be applied a clear coating of 0.004 to 0.007 inch of either polyurethane, melamine or melamine in mixture with aluminum oxide $Al_2O_3$ or similar material.

Figure 4:
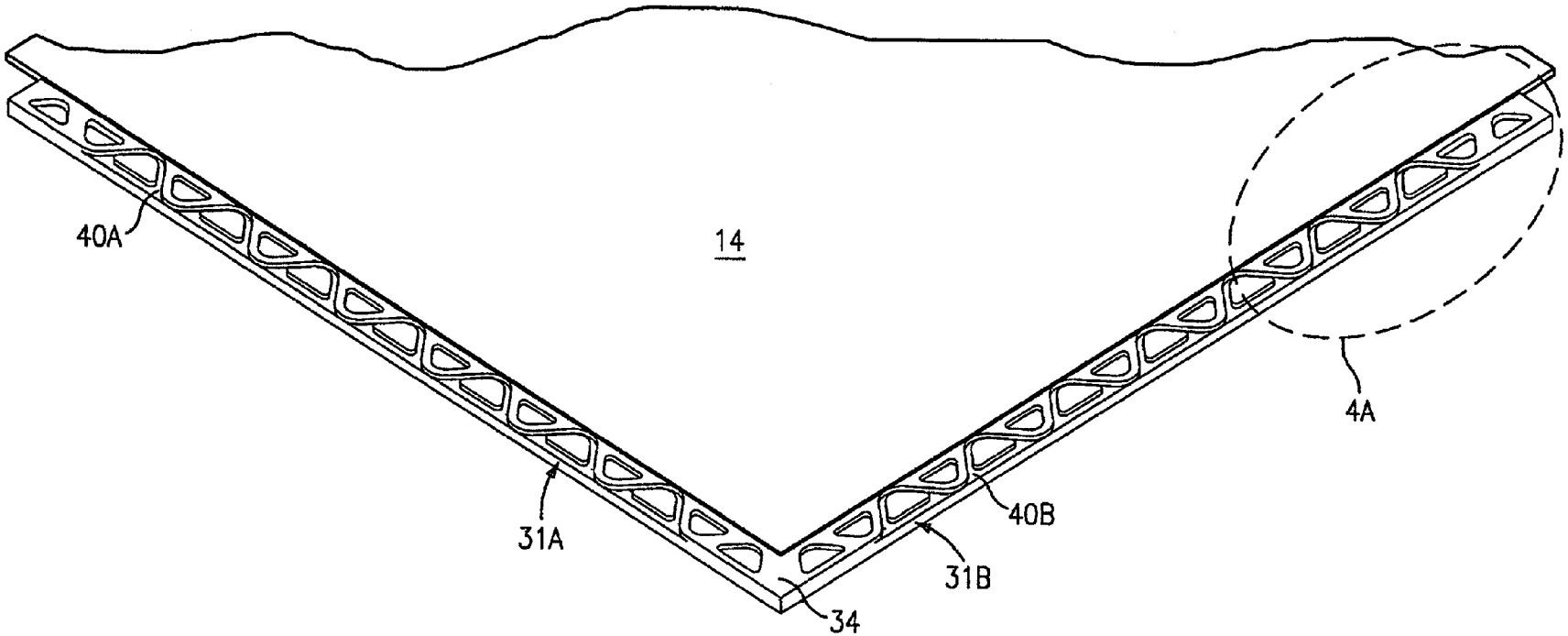
FIG. 4 is an isometric perspective of the right-hand corner of the tile shown in FIG. 2; and, FIG. 4A is an enlargement of the right-hand corner of FIG. 4, delineated by dash lines in FIG. 4 and, FIG. 5 is side view of a portion of the edge of an embodiment of the tile with a decorative and/or wear-resistant top surface thereon.

The second pair of interlock support edges, designated 30A and 30B in FIGS. 2, 4 and 4A, are also comprised of elongated strips 31A, 31B of rectangular cross-section and of substantially identical size and shape as the strips 19A, 19B. Strips 31A and 31B, intersect at right angles to form a second tile corner 34 opposite the corner 24. The strips 31A, 31B extend from, and as continuations of the central portion 12 of top tile surface 13 to provide top border edges coplanar with the plane of the top surface 13 of the central region 10A. The strips 31A, 31B are also cantilevered from edge portions of their respective outer adjoining edges of the bottom central portion 10A and when installed on a substrate are stepped downwardly at right angles thereto to provide the perpendicular or vertical spacing for flush abutments with similar adjoining tiles with their inverted interlocks facing upwardly and their interlock support edges underlying the strips 31A, 31B for mating connections therebetween. The strips 31A, 31B, respectively, have flat, interlock elements support surfaces 40A and 40B, FIGS. 4 and 4A, facing the plane containing the bottom tile surface 14, and hence, are downwardly facing when tile 10 is installed as a floor covering with the bottom surface 14 overlying the substrate. The width of the strips 31A, 31B is substantially the same throughout and substantially the same as that of the strips 19A, 19B. The ends of the strips 31A, 31B opposite the corner 34, FIGS. 1 and 2, may be spaced from the adjacent ends of the strips 19A, 19B, respectively, typically by the width of a strip to provide greater flexibility to both adjacent ends as indicated by numerals 35A and 35B in FIG. 2. As seen in FIGS. 3A and 4A the strips 19A and 19B are substantially mirror images of those on the strips 31A and 31B, respectively, with a pair of interlocks at each end of the strips being especially designed to provide greater mating capability between superimposed interlocks than the intermediate sets of interlocks, as discussed hereinafter.

With reference to FIGS. 1, 3 and 3A, projecting upwardly from each of the surfaces 20A, 20B of their respective strips 19A, 19B are a series of longitudinally-aligned first and second sets of interlock elements molded into the tile, each set being comprised essentially of a differently designed pair of male and female structural types of interlock elements.

The first interlock set of the series, FIG. 3A, disposed along the mid-section of their supporting strip is comprised of a projecting male lug 40 and an adjacent female channel 42; the lug 40, as viewed in plan, being shaped substantially as an equilateral triangle formed of adjoining sidewalls 40-1, 40-2 and 40-3 with rounded corners and a flat upper end surface 40-4. The lugs 40 typically project from their respective strip surfaces 20A and 20B a distance approximately equal to one-half the total thickness of the tile 10, leaving a vertical space between their free end surfaces 40-4 and the top surface of the tile 10 substantially the vertical thickness of their respective corner edges 21A and 21B. The vertical spacing is substantially equal to the support edge thickness of other contiguous tiles substantially identical to the tile 10 with substantially identical interlocks plus any decorative and/or wear resistant layers 11 thereon. Thus, abutting tiles will meet with flush top surfaces and joint lines when edge-connected together by their respective mating interlocks. The end surfaces 40-4, FIG. 3A, of at least one set of lugs 40 may have longitudinal, air venting slots 40-5 therein to facilitate the mold release of the tile 10 from, for example, an injection molding machine.

The sidewalls 40-1, 40-2 and 40-3 of the lugs 40 and adjoining portions of their respective strip surfaces 20A, 20B, FIG. 3A, from one-half of the right-angled wall structure for a channel 40; the other half being formed by the surfaces 20A, 20B and the laterally opposed sidewalls of tandem connected rib sections 50-1 of a continuous male rib wall 50 which traverses the width and extends longitudinally for the major intermediate portion of the length of their respective tile support edges 21A, 21B, 30A and 30B. Each of the male rib sidewall sections 50-1 projects from its respective support edge surface 20A, 20B, FIGS. 3 and 3A, the same amount as the lug 40 and has an inner sidewall section 50-2 spaced laterally from and extending substantially parallel to an opposite one of the outer sidewall sections 50-1. Thus, each traversing section of the wall 50 has a substantially rectangular cross-sectional shape for mating with U-shaped channels such as channels 42. The two rib sections 50-1 define the two legs of each triangular locking structure and depend from a basewall section 50-3, at approximately a 60-degree interior angle. The basewall sections 50-3 is molded flush with the corner edges 21A, 21B of the central region 10A, thereby completing the cavity 60 enclosure.

Each male lug 40, FIG. 3A, is disposed substantially equal distances from its laterally opposed outer sidewalls of sections 50-1 and substantially the same distances from their respective tile edges 22A, 22B. Thus, each male lug 40 is surrounded on three sides by a corresponding female channel 42 of slightly greater width than the width of laterally opposed rib wall sections 50-1 so as to tightly mate with similar but inverted rib wall sections of a contiguous tile. The inner sidewalls 50-2 of each rib 50 are also shaped in plan view as an equilateral triangle having rounded interior corners so as to have a substantially identical size and shape as a corresponding inverted lug 40. The resulting open-ended cavities 60, FIG. 3A, bottoming on their respective enclosed areas of the surfaces, 20A, 20B, have just slightly larger mating interiors than the lug 40 so as to receive inverted lug projections of adjoining tiles with an essentially interference fit.

The outer sidewalls of sections 50-1 of the ribs 50, FIGS. 3 and 3A, are rounded adjacent the tile edges 22A, 22B and otherwise substantially follow the curvature of the lug 40 sidewalls 40-2, 40-3 to facilitate mating therebetween. The spacing between the edges 22A, 22B and their laterally adjacent sidewalls 40-1 of lugs 40 is substantially the width of the channel 42. Thus, each inverted one of the ribs 50 can be accommodated in a corresponding female channel 42 and since each inverted lug 40 can be accommodated in a rib cavity 60, the second set of male-female interlocks is formed by a male rib section 50-1 and its adjoining female cavity 60. As will be apparent, the rib 50 follows a substantially semi-soidal course a substantial length of each support strip 19A, 19B. The rib merges into the central portion 10 adjacent the tile corners, and thus the two endmost lugs 40A, 40B do not have an intervening rib section.

The lugs 40A and 40B are inverted relative to one another and are laterally spaced by a channel section 42A. The sections 42A are typically designed to be somewhat wider than the intermediate channels 42 to correspond with the greater width of their respective vertically aligned inverted male rib sections 50A, 50B of greater width. This is done to assist an installer in making alignments and the initial engagements between the corners of contiguous tiles by providing wider interlocks for initial meshing. Typically, the end rib sections 50A and 50B encircling a respective one of the endmost cavities 61 and 62 are typically about twice as wide as the intermediate ribs 50. Because the rib sections 50A and 50B are about twice as wide as the intervening rib sections 50 readily mesh with the correspondingly wider channels 42A and 42B by the installer aligning and then simply pressing and corner 24 or 34 of tile 10 with its rib sections 50A and 50B and cavities 61 and 62 facing downwards into the upwardly facing lugs 40A, 40B and wider channels 42A, 42B, respectively, of the inverted corresponding corner of a second and substantially identical tile. Once these initial engagements are made at the superimposed tile corners the remaining, intermediate interlocks of the overlapping tiles will be drawn into generally aligned in proper meshing relationships and their relatively tighter intermediate interlock engagements requiring greater forces may be affected by the installer with the use of a tool, such as a mallet. The wider and open-ended design of this initial pair of interlocks facilitates the ease by which individual tiles may be removed from the assemblage by the installer simply raising one corner of the tile to be removed to initiate separation of the contiguous interlocks.

The particular tile described herein is the preferred embodiment of the instant invention but it should be understood that modifications may be made therein without departing from the scope of the invention as defined in the following appended claims. This specification has disclosed all foreseeable equivalents. Terms such as "generally" and "substantially" and the like, as used herein, are to be accorded their ordinary and customary meaning.

What is claimed is:

1. A substantially resilient floor tile for making an adhesive-free interlocking engagement with substantially identical floor tiles, the tile having a flat, central portion with respective upper and lower surfaces and straight edges, said tile comprising:

a least one substantially rectangularly-shaped edging strip of lesser thickness than one edge of said central portion and joined thereto along a longitudinal axis aligned substantially parallel to the one central portion edge to provide corresponding upper and lower cantilevered strip surfaces;

a first set of contiguous male-female interlock elements projecting upwardly from the upper strip surface to a level lower than the plane of said central portion upper surface by a predetermined dimension;

wherein each said set of said contiguous male-female interlock elements is formed by a pair of elongated surfaces comprised of walls spaced laterally apart and extending along the longitudinal axis of the strip, wherein a first surface of the surfaces provides a first male interlock element having a substantially triangular shape, and a second surface of said surfaces forms an open-ended first female interlock element configured to receive a first male interlock element of a second panel.

2. The floor tile as claimed in claim 1, wherein said thickness dimension of said edging strip and said predetermined dimension of said first set of interlock elements are proportioned to provide a substantially flush abutment between substantially identical interlocked tiles.

3. The floor tile as claimed in claim 2, wherein said thickness dimension of said edging strip and said predetermined dimension are substantially the same.

4. The tile as claimed in claim 1, wherein an elongated rib extends parallel to said central portion edge and joins the second surface of the surfaces, thereby forming a substantially triangular, upwardly-projecting enclosure for said first female element.

5. The tile as claimed in claim 4, further comprising:

a second set of male-female interlock elements having a second, substantially triangular wall enclosure projecting from said upper strip surface and disposed in laterally spaced apart, inverted relationship with respect to said first interlock element set, the said wall enclosure of said second interlock element set substantially corresponding in size and shape to the interior dimensions of the first female element.

6. The tile as claimed in claim 5, wherein the triangular wall enclosure of said second male-female interlock element set has one apex disposed adjacent the outer edge of said strip and spaced inwardly therefrom in a direction toward said central portion edge of the title.

7. The tile as claimed in claim 6, wherein the triangular wall enclosure of said first male-female interlock element set has one apex disposed adjacent to, and spaced from, said central portion edge.

8. The tile as claimed in claim 5, wherein there is a succession of said first and second sets of interlock elements alternating along the length of their corresponding strip surface, and wherein the end-most sets of elements are spaced apart further than the intervening first and second sets of interlock elements to facilitate initial engagements with substantially identical overlaid tiles.

* * * * *